US007723969B1

(12) United States Patent
Li

(10) Patent No.: US 7,723,969 B1
(45) Date of Patent: May 25, 2010

(54) SYSTEM AND METHOD FOR PROVIDING A LOW DROP OUT CIRCUIT FOR A WIDE RANGE OF INPUT VOLTAGES

(75) Inventor: Yushan Li, Longmont, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 267 days.

(21) Appl. No.: 11/893,205

(22) Filed: Aug. 15, 2007

(51) Int. Cl.
*G05F 1/569* (2006.01)

(52) U.S. Cl. ..... 323/276; 323/273

(58) Field of Classification Search ..... 323/268–273, 323/275, 276, 280, 281
See application file for complete search history.

(56) References Cited

U.S. PATENT DOCUMENTS

| | | | | |
|---|---|---|---|---|
| 6,188,212 | B1 * | 2/2001 | Larson et al. | 323/281 |
| 6,246,221 | B1 * | 6/2001 | Xi | 323/280 |
| 6,441,591 | B2 | 8/2002 | Nokkonen | |
| 6,541,946 | B1 * | 4/2003 | Chen et al. | 323/280 |
| 6,690,147 | B2 * | 2/2004 | Bonto | 323/280 |
| 6,815,935 | B2 | 11/2004 | Fujii | |
| 6,897,637 | B2 * | 5/2005 | Chen et al. | 323/274 |
| 7,064,533 | B2 | 6/2006 | Hsu | |
| 7,132,891 | B1 | 11/2006 | Dening et al. | |
| 7,167,054 | B1 | 1/2007 | Dening et al. | |
| 7,190,150 | B2 | 3/2007 | Chen et al. | |
| 7,432,693 | B2 * | 10/2008 | Enjalbert | 323/280 |

OTHER PUBLICATIONS

Vahid Yousefzadeh et al., "Digitally Controlled DC-DC Converter for RF Power Amplifier," 2004 IEEE, pp. 81-87.
V. Yousefzadeh et al., "Efficiency Optimization in Linear-Assisted Switching Power Converters for Envelope Tracking in RF Power Amplifiers," 2005 IEEE, pp. 1302-1305.
Biranchinath Sahu et al., "A High Efficiency WCDMA RF Power Amplifier with Adaptive, Dual-Mode Buck-Boost Supply and Bias-Current Control," IEEE Microwave and Wireless Components Letters, vol. 17, No. 3, Mar. 2007, pp. 238-240.
Biranchinath Sahu et al., "System-Level Requirements of DC-DC Converters for Dynamic Power Supplies of Power Amplifiers," 2002 IEEE, pp. 149-152.
Biranchinath Sahu et al., "A High-Efficiency Linear RF Power Amplifier with a Power-Tracking Dynamically Adaptive Buck-Boost Supply," IEEE Transactions on Microwave Theory and Techniques, vol. 52, No. 1, Jan. 2004, pp. 112-120.
Imtiaz All et al., "A Fast Response, Programmable PA Regulator Subsystem for Dual Mode CDMA/AMPS Handsets," 2000 IEEE Radio Frequency Integrated Circuits Symposium, pp. 231-234.

* cited by examiner

*Primary Examiner*—Matthew V Nguyen

(57) ABSTRACT

A system and a method are disclosed for providing a low drop out circuit that can efficiently and correctly handle a wide range of input voltages. A power supply control circuit is provided for a low drop out circuit that comprises an operational amplifier that is coupled to a low drop out transistor. A switcher circuit provides one of a plurality of operating voltages to the low drop out transistor. The power supply control circuit provides a value of an operating voltage to the operational amplifier that enables the operational amplifier to operate the low drop out transistor in a manner that prevents the low drop out transistor from being out of control.

21 Claims, 9 Drawing Sheets

SYSTEM AND METHOD FOR PROVIDING A LOW DROP OUT CIRCUIT FOR A WIDE RANGE OF INPUT VOLTAGES

TECHNICAL FIELD OF THE INVENTION

The present invention is generally directed to the manufacture of semiconductor circuits and, in particular, to a system and method for providing a low drop out (LDO) circuit that can efficiently and correctly handle a wide range of input voltages.

BACKGROUND OF THE INVENTION

The telecommunications industry continually attempts to improve the transmitter circuitry in wireless communication systems. Power amplifier (PA) circuitry is a major component of a transmitter of a wireless communication device. Power amplifier (PA) circuitry provides the power for transmitting a signal (including data modulated and carried by the signal) so that a base station or a receiver can receive the signal.

Power amplifier (PA) circuitry uses a large amount of power. The power amplifier (PA) module is one of the most power consuming components of a wireless communication device. Therefore it is very desirable to provide power amplifier (PA) circuitry that is power efficient.

One method for improving power amplifier (PA) efficiency is to use a drain/collector modulation technique. In the drain/collector modulation technique a non-linear high efficiency power amplifier can be used (e.g., a class C power amplifier) instead of a linear low efficiency power amplifier (e.g., a class A amplifier). The power control of the power amplifier (PA) circuitry is achieved by adjusting the power amplifier (PA) power supply $V_{CC}$. A high efficiency power supply combined with a high efficiency power amplifier (PA) (with constant bias) would be ideal.

In prior art power amplifier (PA) modules in GSM (Global System for Mobile Communications) telecommunication devices such as RF3110 (manufactured by RFMD) and TQM7M4014 (manufactured by Triquint), the power amplifier (PA) power supply $V_{CC}$ is from a linear regulator or "low drop out" (LDO) circuit. An LDO circuit can have a high efficiency when the value of its output voltage ($V_{CC}$) is near the value of its input voltage ($V_{BATT}$). But an LDO circuit will have a very low efficiency when its output voltage ($V_{CC}$) is very low compared with its input voltage ($V_{BATT}$).

The maximum efficiency for an LDO circuit is the ratio of the output voltage $V_{CC}$ to the input voltage $V_{BATT}$. That is, the maximum efficiency is given by the ratio $V_{CC}/V_{BATT}$. For example, the maximum efficiency for an LDO in a typical GSM handset with an output voltage of nine tenths volts ($V_{CC}$=0.9 volts) and an input voltage of three and six tenths volts ($V_{BATT}$=3.6 volts) is twenty five percent (25%).

FIG. 1 illustrates a schematic diagram of a first prior art power supply control circuit 100. Power supply control circuit 100 comprises a low drop out (LDO) circuit 110. Low drop out (LDO) circuit 110 comprises an operational amplifier 120 that receives a $V_{RAMP}$ signal on its inverting input. A feedback voltage signal $V_{FB}$ is provided to the non-inverting input of operational amplifier 120. The operating voltage for low drop out (LDO) circuit 110 is provided by a voltage source $V_{BATT}$.

The output of operational amplifier 120 is provided to a gate of a PMOS transistor 140. The source of PMOS transistor 140 is coupled to the operating voltage $V_{BATT}$. The drain of PMOS transistor 140 is coupled to a first end of a first resistor 150. The second end of first resistor 150 is coupled to a first end of a second resistor 160. The second end of second resistor 160 is coupled to ground. The feedback voltage signal $V_{FB}$ is obtained from a node between the first resistor 150 and the second resistor 160.

The output of low drop out (LDO) circuit 110 is the power supply voltage $V_{CC}$. A capacitor 170 is coupled between the output of the low drop out (LDO) circuit and ground. The power supply voltage $V_{CC}$ is provided to radio frequency (RF) power amplifier (PA) 130. Radio frequency (RF) power amplifier (PA) 130 amplifies an RF input signal ($RF_{IN}$) to generate an amplified RF output signal ($RF_{OUT}$).

One method for increasing the efficiency of the power amplifier (PA) power supply $V_{CC}$ is to use a switching regulator. A switching regulator is able to adjust the value of the operating voltage (designated $V_{SWITCHER}$) that is provided to a low drop out circuit. FIG. 2 illustrates a schematic diagram of a second prior art power supply control circuit 200 that comprises a switching regulator 210 (designated "switcher 210"). Switcher 210 has a first input that receives a peak value of voltage (designated $V_{PEAK}$) and a second input that receives an enable signal (designated EN).

The low drop out circuit 110 in FIG. 2 has the same structure as the low drop out circuit 110 shown in FIG. 1. However, the operation of the low drop out circuit 110 in FIG. 2 no longer has a single value of operating voltage $V_{BATT}$. Instead, switcher 210 provides a wide dynamic range of operating voltages $V_{SWITCHER}$ to the low drop out circuit 110. For example, the value of the operating voltage $V_{SWITCHER}$ may be chosen in a range from about four hundred millivolts (400 mV) to about four and eight tenths volts (4.8 V).

There are some problems, however, that are associated with prior art power supply control circuits of the type that operate with a switcher 210. For example, assume that the power supply for the LDO control amplifier 120 is provided from the operating voltage $V_{BATT}$ (as shown in FIG. 2).

First, when the value of the operating voltage $V_{SWITCHER}$ for the LDO PMOS transistor 140 is greater than the sum of the operating voltage $V_{BATT}$ and the threshold voltage $V_{TP}$ of the LDO PMOS transistor 140, then the LDO PMOS transistor 140 will be in an "on" condition all of the time. The LDO circuit 110 will be out of control in this case.

Second, when the value of the operating voltage $V_{SWITCHER}$ for the LDO PMOS transistor 140 is less than the threshold voltage $V_{TP}$ of the LDO PMOS transistor 140, then the LDO PMOS transistor 140 will be in an "off" condition all of the time. The LDO circuit 110 will also be out of control in this case.

Therefore, there is a need in the art for a system and method that is capable of providing an improved architecture for a power supply control circuit and a low drop out (LDO) circuit that avoids these deficiencies of the prior art circuitry.

SUMMARY OF THE INVENTION

To address the above-discussed deficiencies of the prior art, it is a primary object of the present invention to provide a system and method for providing an improved power supply control circuit and low drop out (LDO) circuit that are capable of efficiently and correctly handling a wide range of input voltages.

One advantageous embodiment of the power supply control circuit of the invention comprises a low drop out (LDO) circuit and a switched power supply circuit. The switched power supply circuit compares a value of voltage from a switching regulator (designated $V_{SWITCHER}$) with a value of voltage (designated $V_{BATT}$) from a battery voltage source. The switched power supply circuit provides either the $V_{BATT}$ voltage or the $V_{SWITCHER}$ voltage (whichever is the higher voltage) to the LDO control amplifier.

Another advantageous embodiment of the power supply control circuit of the invention comprises a low drop out (LDO) circuit that comprises (1) a first control loop comprising a PMOS control transistor that is driven by a first LDO control amplifier, and (2) a second control loop comprising an NMOS control transistor that is driven by a second LDO control amplifier. Control circuitry is provided to ensure that the two control loops do not attempt to operate at the same time.

Another advantageous embodiment of the power supply control circuit of the invention comprises a low drop out (LDO) circuit that comprises (1) a first control loop comprising a PMOS control transistor that is driven by an LDO control amplifier having switched inputs, and (2) a second control loop comprising an NMOS control transistor that is also driven by the LDO control amplifier. Control switching circuitry is provided to ensure that the two control loops do not attempt to operate at the same time.

Another advantageous embodiment of the power supply control circuit of the invention comprises a low drop out (LDO) circuit that comprises (1) a first control loop comprising a PMOS control transistor that is driven by an LDO control amplifier having switched outputs, and (2) a second control loop comprising an NMOS control transistor that is also driven by the LDO control amplifier. Control switching circuitry is provided to ensure that the two control loops do not attempt to operate at the same time.

It is an object of the present invention to provide a system and method for providing an improved power supply control circuit that avoids deficiencies that are present in prior art low drop out circuits.

It is also an object of the present invention to provide a system and method for providing an improved power supply control circuit that comprises a low drop out (LDO) circuit that can efficiently and correctly handle a wide range of input voltages.

It is yet another object of the present invention to provide a system and method for an improved power supply control circuit that comprises a low drop out (LDO) circuit, a switcher circuit, and switched power supply control circuit.

It is another object of the present invention to provide a system and method for an improved power supply control circuit that comprises a low drop out (LDO) circuit, an LDO PMOS transistor that is driven by a first LDO control amplifier, and an LDO NMOS transistor that is driven by a second LDO control amplifier.

It is also another object of the present invention to provide a system and method for an improved power supply control circuit that comprises a low drop out (LDO) circuit, an LDO PMOS transistor that is driven by an LDO control amplifier having switched inputs, and an LDO NMOS transistor that is also driven by the LDO control amplifier having switched inputs.

It is also another object of the present invention to provide a system and method for an improved power supply control circuit that comprises a low drop out (LDO) circuit, an LDO PMOS transistor that is driven by an LDO control amplifier having switched outputs, and an LDO NMOS transistor that is also driven by the LDO control amplifier having switched outputs.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

Before undertaking the Detailed Description of the Invention below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior uses, as well as future uses, of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

Figure 1:
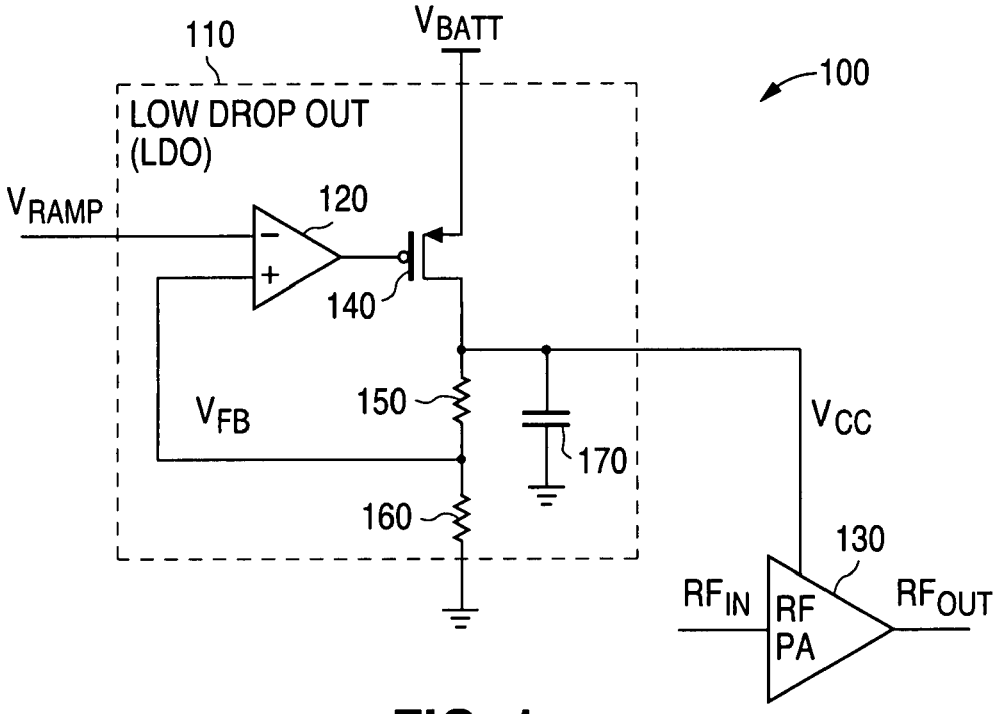
FIG. 1 (PRIOR ART)
FIG. 1 illustrates a schematic diagram of a first prior art power supply control circuit.
Figure 2:
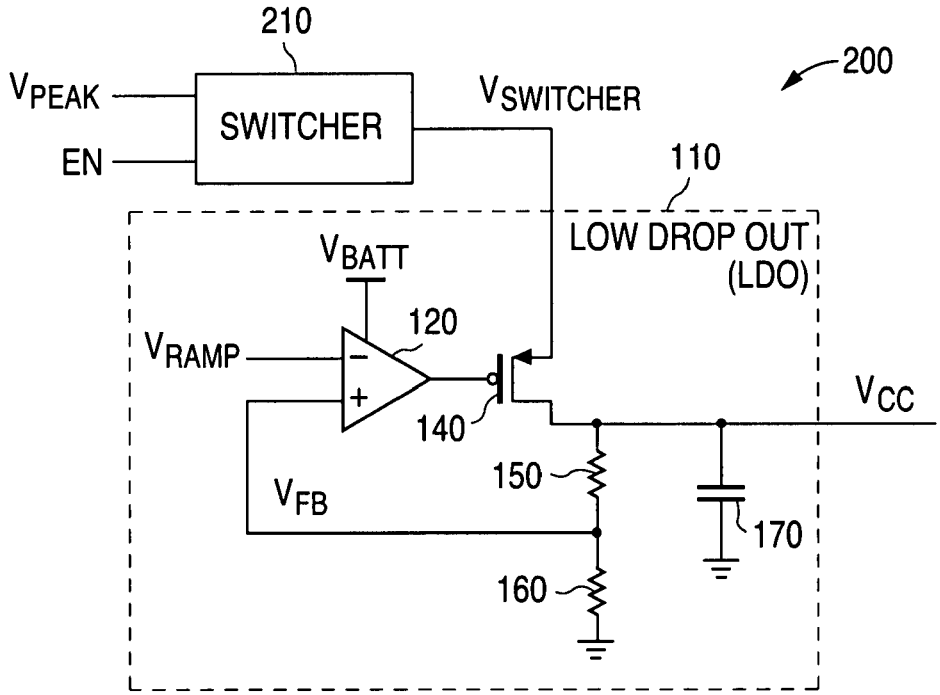
FIG. 2 (PRIOR ART)
FIG. 2 illustrates a schematic diagram of a second prior art power supply control circuit.

FIGS. 1 through 13 and the various embodiments used to describe the principles of the present invention in this patent document are by way of illustration only and should not be construed in any way to limit the scope of the invention. Those skilled in the art will understand that the principles of the present invention may be implemented in any type of suitably arranged power amplifier circuit.

To simplify the drawings the reference numerals from previous drawings will sometimes not be repeated for structures that have already been identified.

Figure 3:
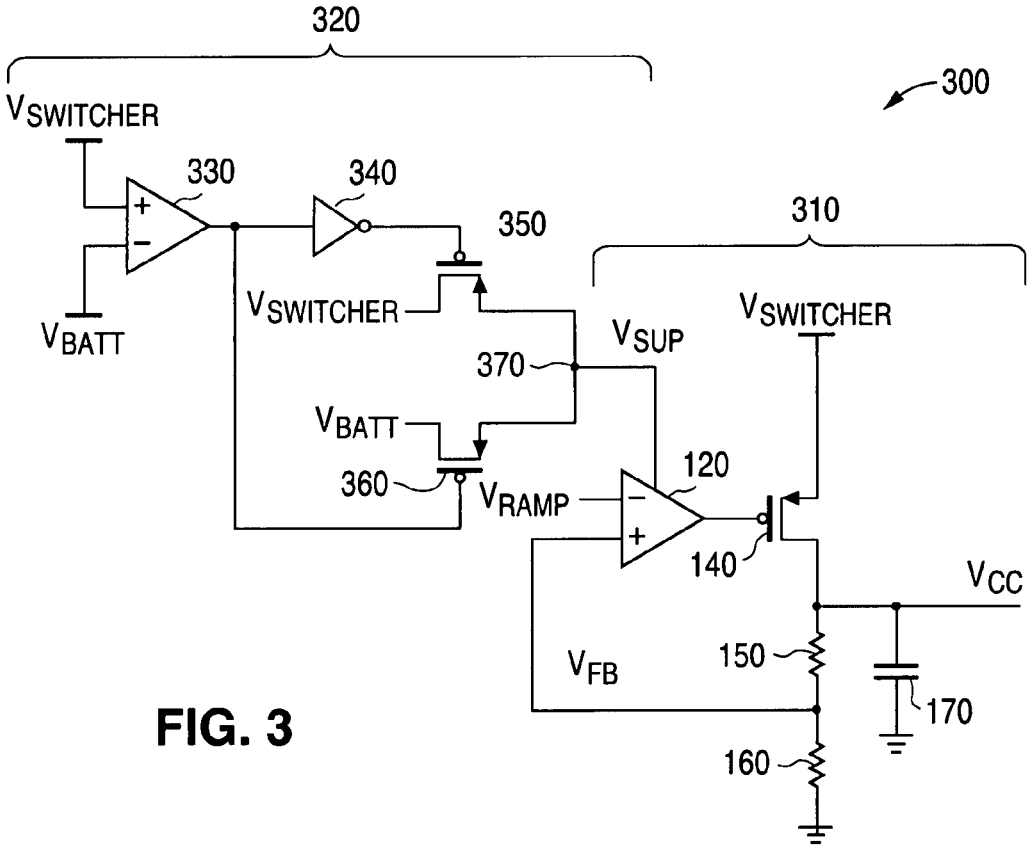
FIG. 3 illustrates a schematic diagram of a first embodiment of a power supply control circuit in accordance with the principles of the present invention.

FIG. 3 illustrates a schematic diagram of a first embodiment of a power supply control circuit 300 that comprises a low drop out circuit 310 and a switched power supply circuit 320 in accordance with the principles of the present invention. As shown in FIG. 3, the switched power supply circuit 320 provides the operating voltage (designated $V_{SUP}$) to the LDO control amplifier 120 of the low drop out circuit 310.

The advantageous embodiment of the present invention embodied in the switched power supply circuit 320 addresses the first problem in the prior art that the LDO PMOS transistor 140 will always be in an "on" condition when the value of the operating voltage $V_{SWITCHER}$ for the LDO PMOS transistor 140 is greater than the sum of the operating voltage $V_{BATT}$ and the threshold voltage $V_{TP}$ of the LDO PMOS transistor 140 (when the power supply for the LDO control amplifier 120 is $V_{BATT}$).

Instead of using a constant value of $V_{BATT}$ for the operating voltage for the LDO control amplifier 120, the switched power supply circuit 320 provides either the $V_{BATT}$ voltage or the $V_{SWITCHER}$ voltage (whichever is the higher voltage) to the LDO control amplifier 120. This ensures that the LDO PMOS transistor 140 is always under control. The LDO control amplifier 120 uses the higher of the two voltages (designated $V_{SUP}$) to prevent the LDO PMOS amplifier 140 from being out of control.

The switched power supply circuit 320 comprises a voltage comparator circuit 330. The voltage comparator circuit 330 receives two voltage inputs. The first input is the $V_{SWITCHER}$ voltage from a switcher regulator 210 of the type shown in FIG. 2. The second input is the $V_{BATT}$ voltage from a battery voltage source (not shown).

The output of the voltage comparator circuit 330 is provided to the input of an inverter circuit 340. The output of the inverter circuit 340 is provided to a gate of a first PMOS transistor 350. The output of the voltage comparator circuit 330 is also directly provided to a gate of a second PMOS transistor 360.

As shown in FIG. 3, a source of the first PMOS transistor 350 is connected to a source of the second PMOS transistor 360 at node 370. The drain of the first PMOS transistor 350 is connected to the $V_{SWITCHER}$ voltage. The drain of the second PMOS transistor 360 is connected to the $V_{BATT}$ voltage. The node 370 is connected to the LDO control amplifier 120. The voltage signal that is present at the node 370 provides the operating voltage to power the LDO control amplifier 120.

If the value of the $V_{SWITCHER}$ voltage is greater than the $V_{BATT}$ voltage, then the voltage comparator circuit 330 will output a "high" signal. The "high" signal will go through the inverter circuit 340 and become a "low" signal to turn on the first PMOS transistor 350 to provide the $V_{SWITCHER}$ voltage to the node 370. At the same time, the "high" signal will turn off the second PMOS transistor 360 so that the $V_{BATT}$ voltage will not be present at the node 370.

If the value of the $V_{BATT}$ voltage is greater than the $V_{SWITCHER}$ voltage, then the voltage comparator circuit 330 will output a "low" signal. The "low" signal will go through the inverter circuit 340 and become a "high" signal to turn off the first PMOS transistor 350 to prevent the $V_{SWITCHER}$ voltage from being present at the node 370. At the same time, the "low" signal will turn on the second PMOS transistor 360 so that the $V_{BATT}$ voltage will be present at the node 370.

In this manner, the switched power supply circuit 320 provides either the $V_{BATT}$ voltage or the $V_{SWITCHER}$ voltage (whichever is the higher voltage) to the LDO control amplifier 120. This ensures that the LDO PMOS transistor 140 is always properly operating and is always under control. As previously mentioned, the LDO control amplifier 120 uses the higher of the two voltages (designated $V_{SUP}$) to prevent the LDO PMOS amplifier 140 from being out of control.

Figure 4:
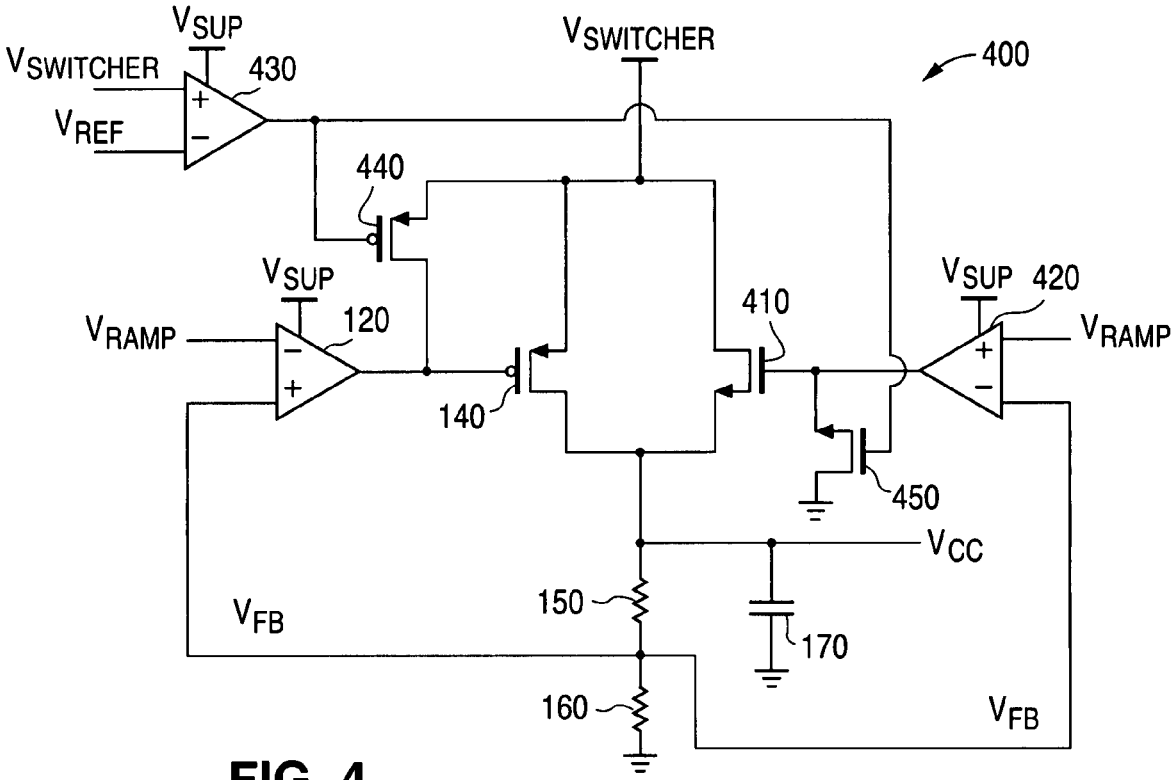
FIG. 4 illustrates a schematic diagram of a second embodiment of a power supply control circuit in accordance with the principles of the present invention.

FIG. 4 illustrates a schematic diagram of a second embodiment of a power supply control circuit 400 that comprises a low drop out circuit and a switched power supply circuit in accordance with the principles of the present invention. As shown in FIG. 4, instead of using a LDO PMOS transistor 140 alone, an LDO NMOS transistor 410 is used in parallel with the LDO PMOS transistor 140 and a second LDO control amplifier 420 is used to drive the LDO NMOS transistor 410.

The advantageous embodiment of the present invention shown in FIG. 4 addresses the second problem in the prior art that the LDO PMOS transistor 140 will always be in an "off" condition when the value of the operating voltage $V_{SWITCHER}$ for the LDO PMOS transistor 140 is less than the threshold voltage $V_{TP}$ of the LDO PMOS transistor 140.

As shown in FIG. 4, the source of the LDO PMOS transistor 140 and the drain of the LDO NMOS transistor 410 are both connected to the $V_{SWITCHER}$ voltage. The drain of the LDO PMOS transistor 140 and the source of the LDO NMOS transistor 410 are both connected to the output node $V_{CC}$. The output of the second LDO control amplifier 420 is connected to the gate of the LDO NMOS transistor 410.

The operating voltage for both the first LDO control amplifier 120 and the second LDO control amplifier 420 is provided by the $V_{SUP}$ voltage source that has been described with reference to FIG. 3. As previously explained, the value of the $V_{SUP}$ voltage is the greater of the $V_{SWITCHER}$ voltage and the $V_{BATT}$ voltage.

To prevent the loop with the first LDO control amplifier 120 and the loop with the second LDO control amplifier 420 from trying to operate at the same time (which would cause output distortion), a loop control switch circuit is provided to ensure that the appropriate loop is operating at the appropriate time. The loop control switch circuit comprises loop control voltage comparator 430, a loop control PMOS transistor 440, and a loop control NMOS transistor 450 coupled to the power supply control circuit 400 as shown in FIG. 4.

The source of the loop control PMOS transistor 440 is coupled to the $V_{SWITCHER}$ voltage. The drain of the of the loop control PMOS transistor 440 is coupled to a node located between the output of the first LDO control amplifier 120 and the gate of the LDO PMOS transistor 140. The gate of the loop control PMOS transistor 440 is coupled to the output of the loop control voltage comparator 430.

The source of the loop control NMOS transistor 450 is coupled to a node located between the output of the second LDO control amplifier 420 and the gate of the LDO NMOS transistor 410. The drain of the loop control NMOS transistor 450 is coupled to ground. The gate of the loop control NMOS transistor 450 is coupled to the output of the loop control voltage comparator 430.

The operating voltage for the loop control voltage comparator 430 is provided by the $V_{SUP}$ voltage source that has been described with reference to FIG. 3. As previously explained, the value of the $V_{SUP}$ voltage is the greater of the $V_{SWITCHER}$ voltage and the $V_{BATT}$ voltage.

A first input to the loop control voltage comparator 430 receives the $V_{SWITCHER}$ voltage. A second input to the loop control voltage comparator 430 receives a reference voltage (designated $V_{REF}$). The reference voltage $V_{REF}$ is greater than the threshold voltage $V_{TP}$ of the LDO PMOS transistor 140 and greater than the threshold voltage $V_{TP}$ of the LDO NMOS transistor 410. The value of the reference voltage $V_{REF}$ is selected to enable the loop control voltage comparator 430 to select the appropriate control loop. The value of the reference voltage $V_{REF}$ may be selected because the desired level of the $V_{SWITCHER}$ voltage is a known quantity.

If the value of the $V_{SWITCHER}$ voltage is greater than the $V_{REF}$ voltage, then the loop control voltage comparator 430 will output a "high" signal. The "high" signal will turn on the loop control NMOS transistor 450. At the same time, the "high" signal will turn off the loop control PMOS transistor 440. This will select the first control loop for operation that has the first LDO control amplifier 120.

If the value of the $V_{REF}$ voltage is greater than the $V_{SWITCHER}$ voltage, then the loop control voltage comparator 430 will output a "low" signal. The "low" signal will turn off the loop control NMOS transistor 450. At the same time, the "low" signal will turn on the loop control PMOS transistor 440. This will select the second control loop for operation that has the second LDO control amplifier 420.

In this manner, the loop control voltage comparator 430 provides a switch that alternately operates either the control loop with the first LDO control amplifier 120 or the control loop with the second LDO control amplifier 420.

Figure 5:
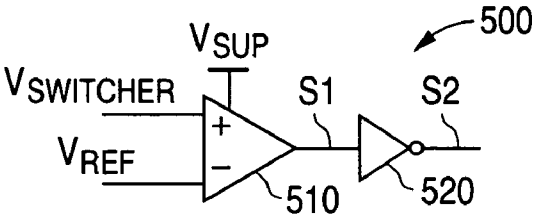
FIG. 5 illustrates a schematic diagram of a switch control voltage comparator and inverter circuit in accordance with the principles of the present invention.
Figure 6:
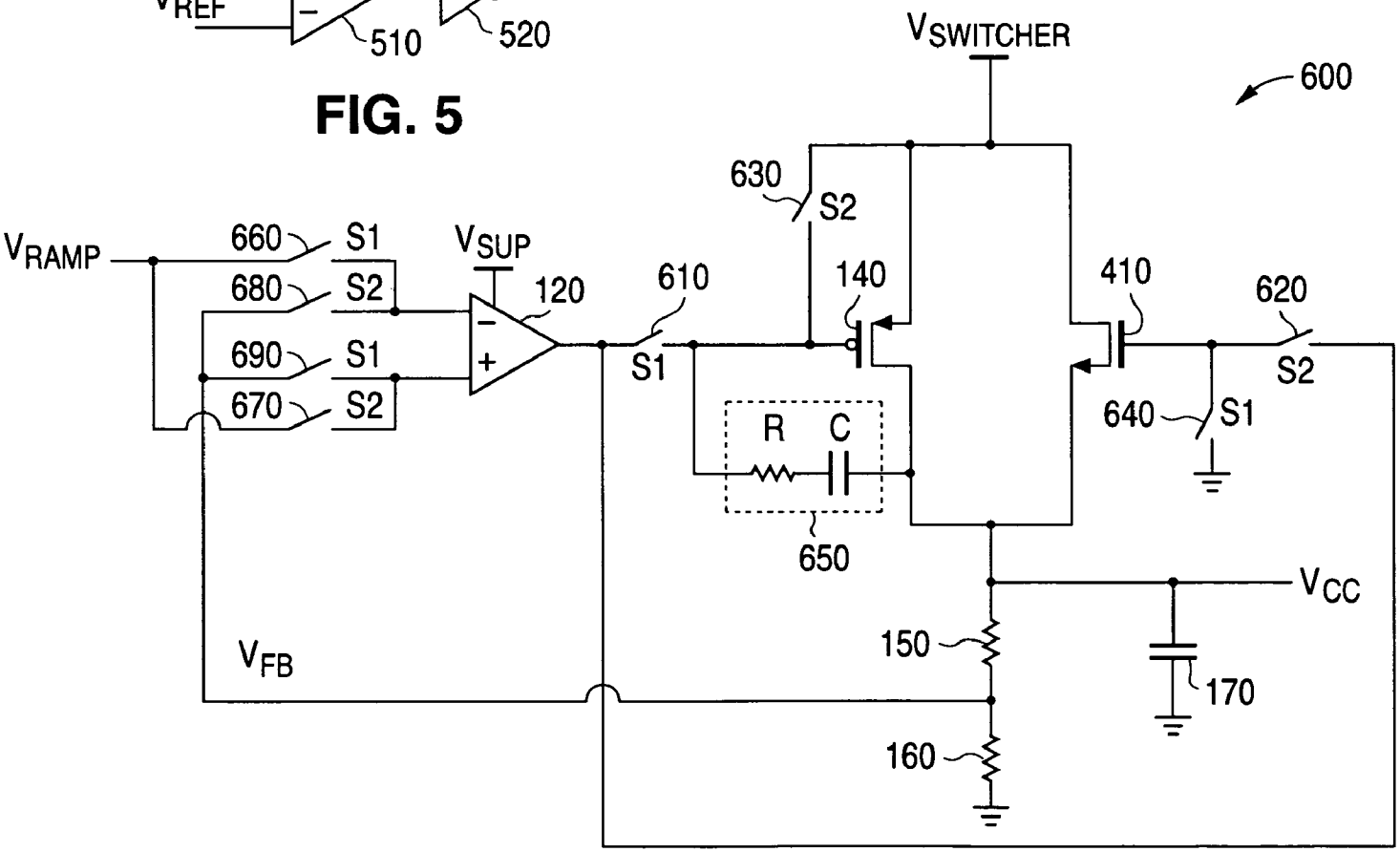
FIG. 6 illustrates a schematic diagram of a third embodiment of a power supply control circuit in accordance with the principles of the present invention.

FIG. 5 and FIG. 6 illustrate schematic diagrams of a third embodiment of a power supply control circuit 600 that comprises a low drop out circuit and a switched power supply circuit in accordance with the principles of the present invention. As shown in FIG. 6, instead of using a first LDO control amplifier 120 for the LDO PMOS transistor 140 and a second LDO control amplifier 420 for the LDO NMOS transistor 410 as shown in FIG. 4, the LDO control amplifier 120 is used for both control loops.

FIG. 5 illustrates an advantageous embodiment 500 of a switch control voltage comparator 510 and inverter circuit 520 in accordance with the principles of the present invention. The operating voltage for the switch control voltage comparator 510 is provided by the $V_{SUP}$ voltage source that has been described with reference to FIG. 3. As previously explained, the value of the $V_{SUP}$ voltage is the greater of the $V_{SWITCHER}$ voltage and the $V_{BATT}$ voltage.

A first input to the switch control voltage comparator 510 receives the $V_{SWITCHER}$ voltage. A second input to the switch control voltage comparator 510 receives a reference voltage (designated $V_{REF}$). The reference voltage $V_{REF}$ is greater than the threshold voltage $V_{TP}$ of the LDO PMOS transistor 140 and greater than the threshold voltage $V_{TP}$ of the LDO NMOS transistor 410. The value of the reference voltage $V_{REF}$ is selected to enable the switch control voltage comparator 510 to select the appropriate switch controls for controlling the two loops. The value of the reference voltage $V_{REF}$ may be selected because the desired level of the $V_{SWITCHER}$ voltage is a known quantity.

The output of the switch control voltage comparator 510 represents a "Switch One" signal (designated S1). The S1 output of the switch control voltage comparator 510 is provided to the input of an inverter circuit 520. The output of the inverter circuit 520 represents a "Switch Two" signal (designated S2). As will be more fully described, the S1 switch signal and the S2 switch signal operate various S1 switches and S2 switches in the power supply control circuit 600.

If the value of the $V_{SWITCHER}$ voltage is greater than the $V_{REF}$ voltage, then the switch control voltage comparator 510 will output a "high" signal. The S1 switch signal will be a "high" signal and the S2 switch signal will be a "low" signal when the value of the $V_{SWITCHER}$ voltage is greater than the $V_{REF}$ voltage.

If the value of the $V_{SWITCHER}$ voltage is less than the $V_{REF}$ voltage, then the switch control voltage comparator 510 will output a "low" signal. The S1 switch signal will be a "low" signal and the S2 switch signal will be a "high" signal when the value of the $V_{SWITCHER}$ voltage is less than the $V_{REF}$ voltage.

As shown in FIG. 6, the power supply control circuit 600 comprises an LDO control amplifier 120 having an output that is coupled through an S1 switch 610 to a gate of the LDO PMOS transistor 140. The output of the LDO control amplifier 120 is also coupled through an S2 switch 620 to a gate of the LDO NMOS transistor 410. As in the second embodiment 400 of the present invention, the LDO PMOS transistor 140 and the LDO NMOS transistor 410 are coupled in parallel. The source of the LDO PMOS transistor 140 and the drain of the LDO NMOS transistor 410 are both coupled to the $V_{SWITCHER}$ voltage. The drain of the LDO PMOS transistor 140 and the source of the LDO NMOS transistor 410 are both connected to the output node $V_{CC}$.

An S2 switch 630 is also coupled between the gate and the source of the LDO PMOS transistor 140. A first end of an S1 switch 640 is coupled to a node between the gate of the LDO NMOS transistor 410 and the S2 switch 620. A second end of the S1 switch 640 is coupled to ground. A compensation circuit 650 is also provided that comprises a resistor R in series with a capacitor C. A first end of the compensation circuit 650 is coupled between the S1 switch 610 and the S2 switch 630. A second end of the compensation circuit 650 is coupled to the drain of the LDO PMOS transistor 140.

The $V_{RAMP}$ signal may be provided to the inverting input of the LDO control amplifier 120 through an S1 switch 660 or to the noninverting input of the LDO control amplifier 120 through an S2 switch 670. Similarly, the feedback signal $V_{FB}$ may be provided to the inverting input of the LDO control amplifier 120 through an S2 switch 680 or to the noninverting input of the LDO control amplifier 120 through an S1 switch 690.

As previously mentioned, when the value of the $V_{SWITCHER}$ voltage is greater than the $V_{REF}$ voltage, then the switch control voltage comparator 510 will output a "high" signal. The S1 switch signal will be a "high" signal and the S2 switch signal will be a "low" signal. The "high" S1 signal will close the S1 switches and the "low" S2 signal will open the S2 switches. In particular, the "high" S1 signal will close S1 switch 610, S1 switch 640, S1 switch 660 and S1 switch 690. The "low" S2 signal will open S2 switch 620, S2 switch 630, S2 switch 670 and S2 switch 680. This will select the first control loop for operation.

When the value of the $V_{SWITCHER}$ voltage is less than the $V_{REF}$ voltage, then the switch control voltage comparator 510 will output a "low" signal. The S1 switch signal will be a "low" signal and the S2 switch signal will be a "high" signal. The "low" S1 signal will open the S1 switches and the "high" S2 signal will close the S2 switches. In particular, the "low" S1 signal will open S1 switch 610, S1 switch 640, S1 switch 660 and S1 switch 690. The "high" S2 signal will close S2 switch 620, S2 switch 630, S2 switch 670 and S2 switch 680. This will select the second control loop for operation.

Because the LDO PMOS transistor 140 introduces an inverting gain stage, the inputs are switched in the two control loops. The compensation is different in the two control loops because the LDO NMOS transistor 410 is a unit gain follower.

Figure 7:
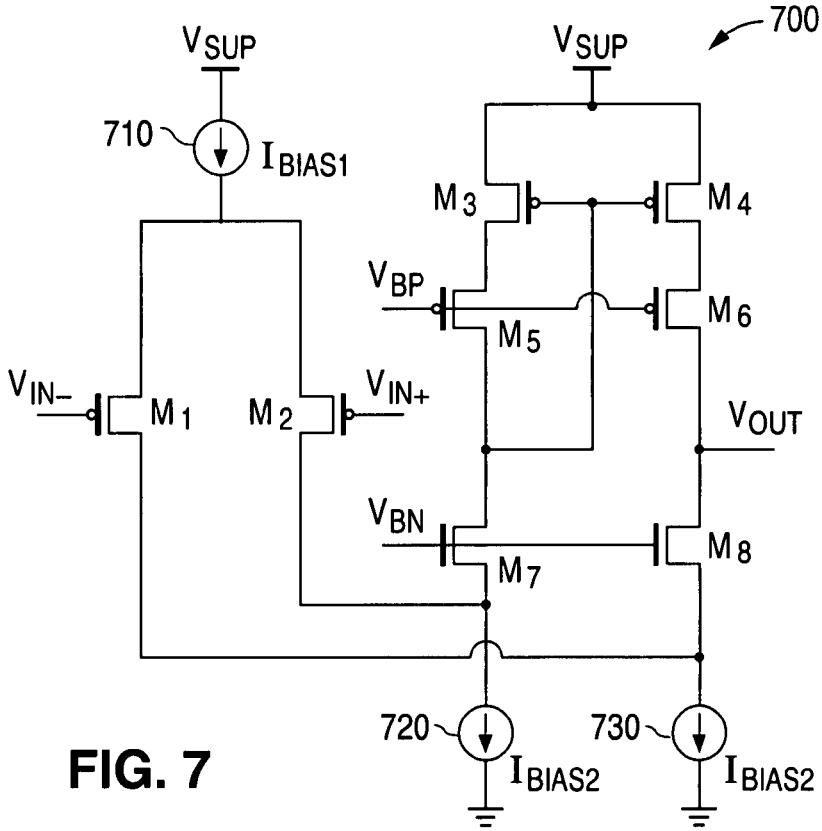
FIG. 7 illustrates an exemplary embodiment of a low drop out control amplifier circuit in accordance with the principles of the present invention.

FIG. 7 illustrates an exemplary embodiment 700 of the LDO control amplifier 120 in accordance with the principles of the present invention. As shown in FIG. 7, the operating voltage of the LDO control amplifier 120 in embodiment 700 is the $V_{SUP}$ voltage that is provided by the switched power supply circuit 320. The LDO control amplifier 120 in embodiment 700 comprises eight transistors (M1 through M8) coupled together as shown in FIG. 7.

A bias current source 710 provides a bias current (designated $I_{BIAS1}$) to transistor M1 and transistor M2. A bias current source 720 provides a bias current (designated $I_{BIAS2}$) to transistor M3, transistor M5, transistor M7, and transistor M2. A bias current source 730 provides a bias current (designated $I_{BIAS2}$) to transistor M4, transistor M6, transistor M8, and transistor M1.

Figure 8:
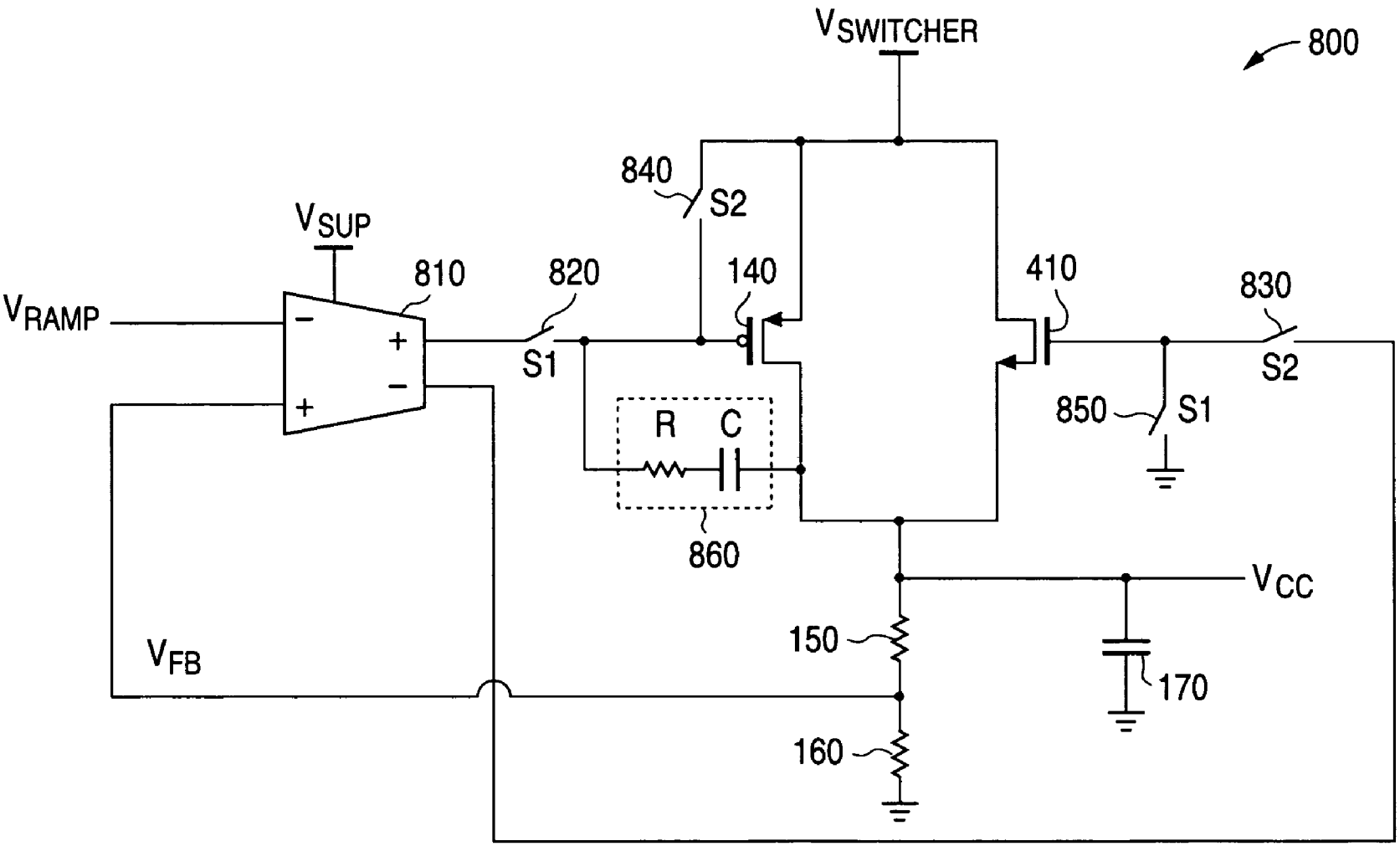
FIG. 8 illustrates a schematic diagram of a fourth embodiment of a power supply control circuit in accordance with the principles of the present invention.
Figure 10:
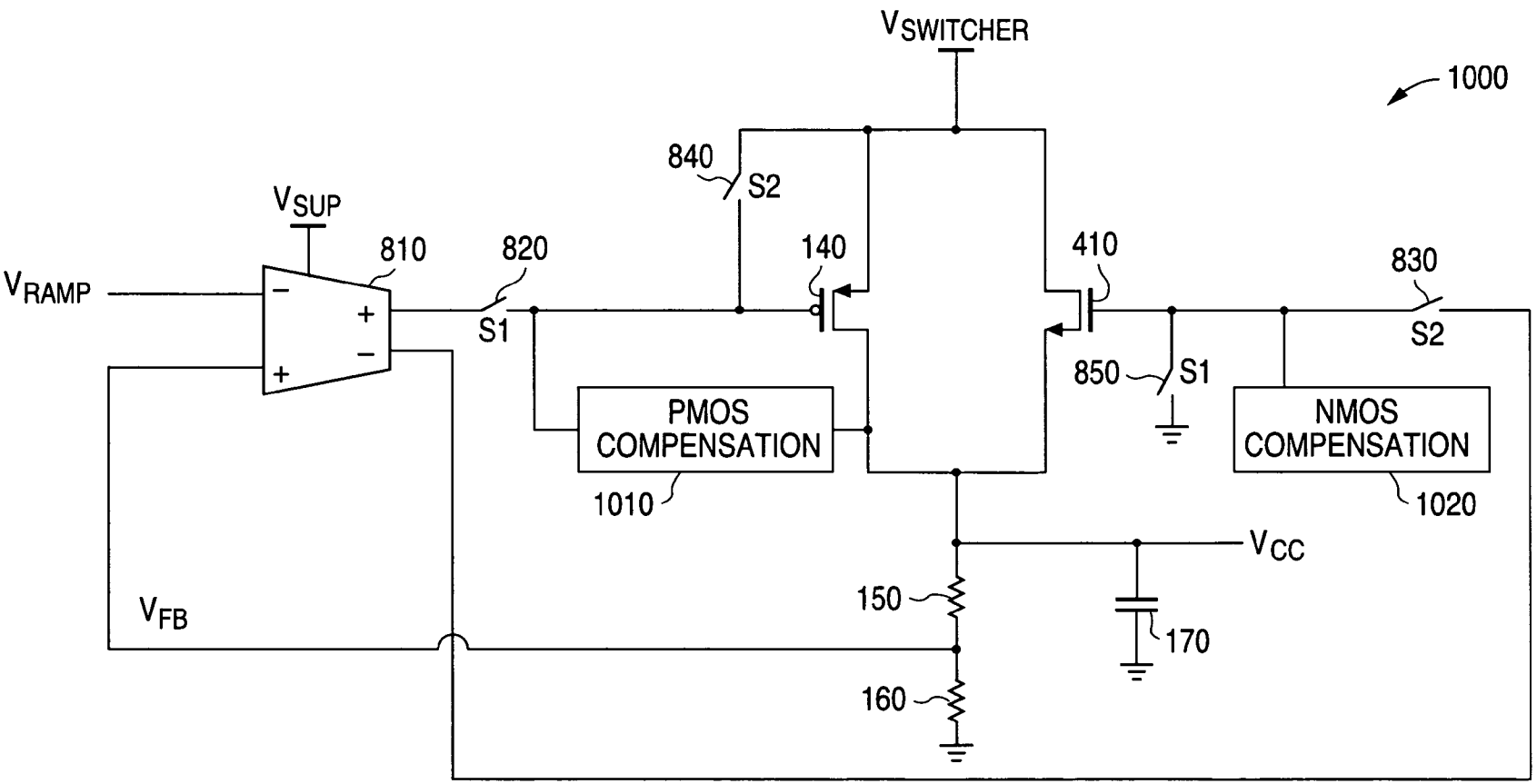
FIG. 10 illustrates a schematic diagram of a fifth embodiment of a power supply control circuit in accordance with the principles of the present invention.

FIG. 8 illustrates a schematic diagram of a fourth embodiment of a power supply control circuit 800 that comprises a low drop out circuit and a switched power supply circuit in accordance with the principles of the present invention. In the embodiment shown in FIG. 8, instead of switching the inputs as shown in FIG. 6, the amplifier outputs are switched.

The power supply control circuit 800 comprises an LDO control amplifier 810 having a first output that is coupled through an S1 switch 820 to a gate of the LDO PMOS transistor 140. The LDO control amplifier 810 also has a second output that is coupled through an S2 switch 830 to a gate of the LDO NMOS transistor 410. The LDO PMOS transistor 140 and the LDO NMOS transistor 410 are coupled in parallel. The source of the LDO PMOS transistor 140 and the drain of the LDO NMOS transistor 410 are both coupled to the $V_{SWITCHER}$ voltage. The drain of the LDO PMOS transistor 140 and the source of the LDO NMOS transistor 410 are both connected to the output node $V_{CC}$.

An S2 switch 840 is also coupled between the gate and the source of the LDO PMOS transistor 140. A first end of an S1 switch 850 is coupled to a node between the gate of the LDO NMOS transistor 410 and the S2 switch 830. A second end of the S1 switch 850 is coupled to ground. A compensation circuit 860 is also provided that comprises a resistor R in series with a capacitor C. A first end of the compensation circuit 860 is coupled between the S1 switch 820 and the S2 switch 840. A second end of the compensation circuit 860 is coupled to the drain of the LDO PMOS transistor 140.

When the value of the $V_{SWITCHER}$ voltage is greater than the $V_{REF}$ voltage, then the switch control voltage comparator 510 will output a "high" signal. The S1 switch signal will be a "high" signal and the S2 switch signal will be a "low" signal. The "high" S1 signal will close the S1 switches and the "low" S2 signal will open the S2 switches. In particular, the "high" S1 signal will close S1 switch 820 and S1 switch 850. The "low" S2 signal will open S2 switch 830 and S2 switch 840. This will select the first control loop for operation.

When the value of the $V_{SWITCHER}$ voltage is less than the $V_{REF}$ voltage, then the switch control voltage comparator 510 will output a "low" signal. The S1 switch signal will be a "low" signal and the S2 switch signal will be a "high" signal. The "low" S1 signal will open the S1 switches and the "high" S2 signal will close the S2 switches. In particular, the "low" S1 signal will open S1 switch 820 and S1 switch 850. The "high" S2 signal will close S2 switch 830 and S2 switch 840. This will select the second control loop for operation.

Figure 9:
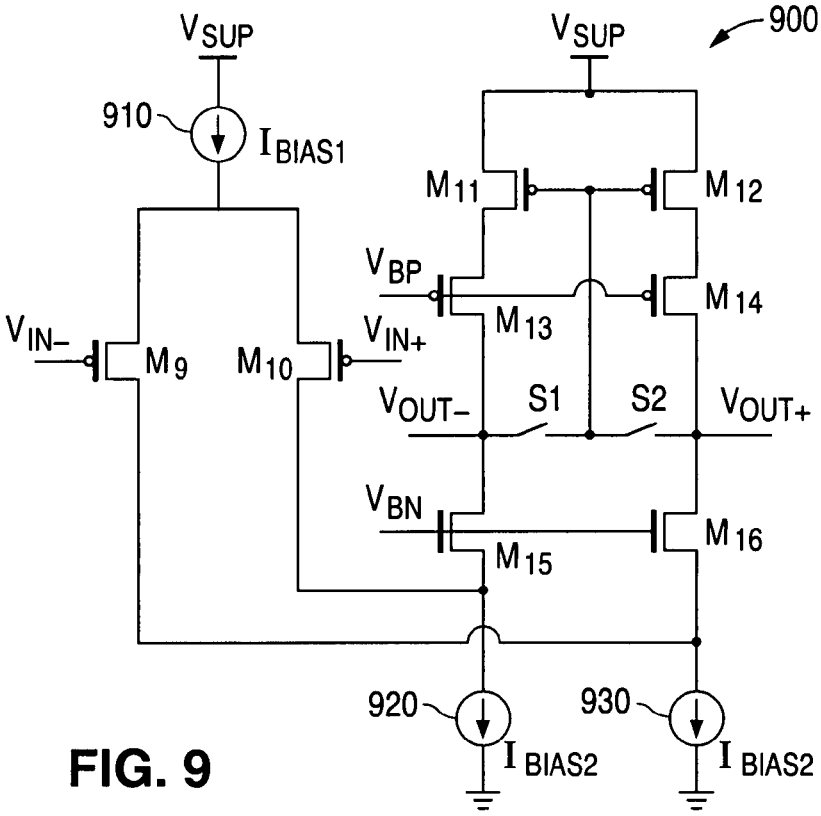
FIG. 9 illustrates another exemplary embodiment of a low drop out control amplifier circuit in accordance with the principles of the present invention.

FIG. 9 illustrates an exemplary embodiment 900 of the LDO control amplifier 810 in accordance with the principles of the present invention. As shown in FIG. 9, the operating voltage of the LDO control amplifier 810 in embodiment 900 is the $V_{SUP}$ voltage that is provided by the switched power supply circuit 320. The LDO control amplifier 810 in embodiment 900 comprises eight transistors (M9 through M16) coupled together as shown in FIG. 9.

A bias current source 910 provides a bias current (designated $I_{BIAS1}$) to transistor M9 and transistor M10. A bias current source 920 provides a bias current (designated $I_{BIAS2}$) to transistor M11, transistor M13, transistor M15, and transistor M9. A bias current source 930 provides a bias current (designated $I_{BIAS2}$) to transistor M12, transistor M14, transistor M16, and transistor M10.

In FIG. 6 there is an RC Miller compensation circuit 650 shown in the PMOS control loop. Similarly, in FIG. 8 there is an RC Miller compensation circuit 860 shown in the PMOS control loop. This is because there are two gain stages in the PMOS control loop. The capacitor C is used to create a dominant pole at the output of the first stage and the resistor R is used to create a zero to improve the phase margin.

The compensation circuits (650 and 860) are switched off for the NMOS control loop. Because the NMOS control loop has a one gain stage followed by a unit gain follower, the pole from the second stage could be a very high frequency pole, so that the compensation may not be necessary for the NMOS control loop.

However, in general, two independent compensation circuits may be switched in and out for the two different control loops. This feature is shown in the fifth embodiment of the power supply control circuit 1000 shown in FIG. 10.

The power supply control circuit 1000 comprises an LDO control amplifier 810 having a first output that is coupled through an S1 switch 820 to a gate of the LDO PMOS transistor 140. The LDO control amplifier 810 also has a second output that is coupled through an S2 switch 830 to a gate of the LDO NMOS transistor 410. The LDO PMOS transistor 140 and the LDO NMOS transistor 410 are coupled in parallel. The source of the LDO PMOS transistor 140 and the drain of the LDO NMOS transistor 410 are both coupled to the $V_{SWITCHER}$ voltage. The drain of the LDO PMOS transistor 140 and the source of the LDO NMOS transistor 410 are both connected to the output node $V_{CC}$.

An S2 switch 840 is also coupled between the gate and the source of the LDO PMOS transistor 140. A first end of an S1 switch 850 is coupled to a node between the gate of the LDO NMOS transistor 410 and the S2 switch 830. A second end of the S1 switch 850 is coupled to ground.

A PMOS compensation circuit 1010 is also provided. A first end of the compensation circuit 1010 is coupled between the S1 switch 820 and the S2 switch 840. A second end of the PMOS compensation circuit 1010 is coupled to the drain of the LDO PMOS transistor 140. An NMOS compensation circuit 1020 is also provided. The NMOS compensation circuit 1020 is coupled to a node between the first end of the S1 switch 850 and the S2 switch 830.

When the value of the $V_{SWITCHER}$ voltage is greater than the $V_{REF}$ voltage, then the switch control voltage comparator 510 will output a "high" signal. The S1 switch signal will be a "high" signal and the S2 switch signal will be a "low" signal.

The "high" S1 signal will close the S1 switches and the "low" S2 signal will open the S2 switches. In particular, the "high" S1 signal will close S1 switch 820 and S1 switch 850. The "low" S2 signal will open S2 switch 830 and S2 switch 840. This will select the first control loop for operation.

When the value of the $V_{SWITCHER}$ voltage is less than the $V_{REF}$ voltage, then the switch control voltage comparator 510 will output a "low" signal. The S1 switch signal will be a "low" signal and the S2 switch signal will be a "high" signal. The "low" S1 signal will open the S1 switches and the "high" S2 signal will close the S2 switches. In particular, the "low" S1 signal will open S1 switch 820 and S1 switch 850. The "high" S2 signal will close S2 switch 830 and S2 switch 840. This will select the second control loop for operation.

The embodiments of the invention that have been described are designed so that only one of the two control loops operates at the same time. Selecting on one control loop to operate at a given time is referred to as "static selection" because the selection of one of the control loops is done before the beginning of the transmittal time slot. This is the case in GSM (Global System for Mobile Communications) applications.

However, this is not the case in WCDMA (wideband code division multiple access) applications, where the selection of the control loop may have to be dynamically selected during the transmitting state. For example, when an output voltage $V_{CC}$ is commanded during a transmitting state, the control loop selection has to be done on the fly. This means that there will be a short period of time during which both control loops are operating at the same time.

Figure 11:
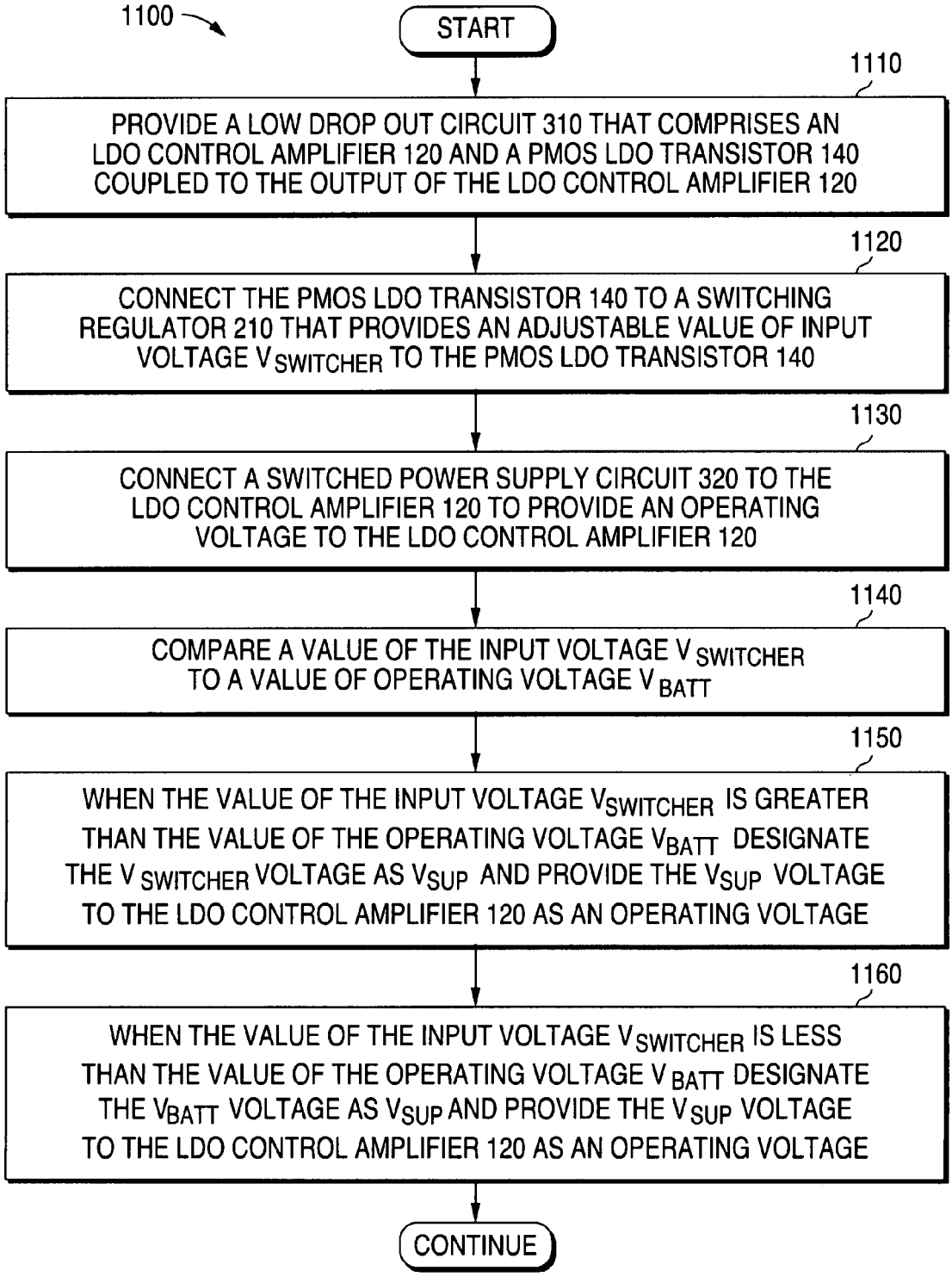
FIG. 11 illustrates a flow chart showing the steps of a first advantageous embodiment of the method of the present invention.

FIG. 11 illustrates a flow chart showing the steps 1100 of a first advantageous embodiment of the method of the present invention. In the first step of the method a low drop out (LDO) circuit 310 is provided that comprises an LDO control amplifier 120 and a PMOS LDO transistor 140 that is coupled to the output of the LDO control amplifier 120 (step 1110). Then the PMOS LDO transistor 140 is connected to a switching regulator 210 that provides an adjustable value of input voltage $V_{SWITCHER}$ to the PMOS LDO transistor 140 (step 1120).

Then a switched power supply circuit 320 is connected to the LDO control amplifier 120 to provide an operating voltage to the LDO control amplifier 120 (step 1130). Then a value of the input voltage $V_{SWITCHER}$ is compared to a value of the operating voltage $V_{BATT}$ (step 1140).

When the value of the input voltage $V_{SWITCHER}$ is greater than the value of the operating voltage $V_{BATT}$ then the $V_{SWITCHER}$ voltage is designated as $V_{SUP}$ and the $V_{SUP}$ voltage is provided to the LDO control amplifier 120 as an operating voltage (step 1150). When the value of the input voltage $V_{SWITCHER}$ is less than the value of the operating voltage $V_{BATT}$ then the $V_{BATT}$ voltage is designated as $V_{SUP}$ and the $V_{SUP}$ voltage is provided to the LDO control amplifier 120 as an operating voltage (step 1160).

Figure 12:
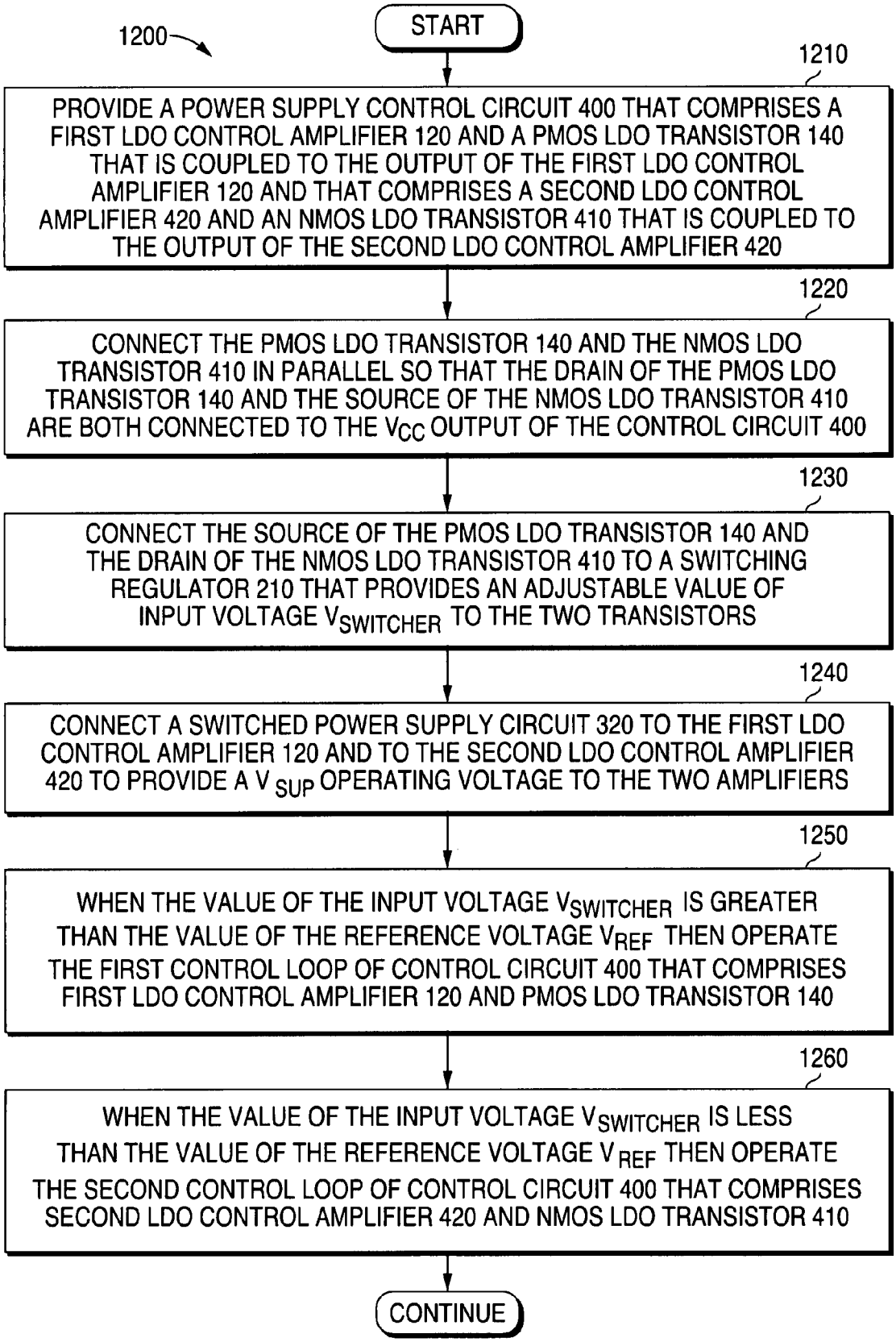
FIG. 12 illustrates a flow chart showing the steps of a second advantageous embodiment of the method of the present invention.

FIG. 12 illustrates a flow chart showing the steps 1200 of a second advantageous embodiment of the method of the present invention. In the first step of the method a power supply control circuit 400 is provided that comprises (1) a first LDO control amplifier 120 and a PMOS LDO transistor 140 that is coupled to the output of the first LDO control amplifier 120, and (2) a second LDO control amplifier 420 and an NMOS LDO transistor 410 that is coupled to the output of the second LDO control amplifier (step 1210). Then the PMOS LDO transistor 140 and the NMOS LDO transistor 410 are connected in parallel so that the drain of the LDO PMOS transistor 140 and the source of the LDO NMOS transistor 410 are both connected to the $V_{CC}$ output of the power supply control circuit 400 (step 1220).

Then the source of the PMOS LDO transistor 140 and the drain of the NMOS LDO transistor 410 are connected to a switching regulator 210 that provides an adjustable value of input voltage $V_{SWITCHER}$ to the two transistors (step 1230). Then a switched power supply circuit 320 is connected to the first LDO control amplifier 120 and to the second LDO control amplifier 420 to provide a $V_{SUP}$ operating voltage to the two control amplifiers (step 1240).

When the value of the input voltage $V_{SWITCHER}$ is greater than the value of the reference voltage $V_{REF}$ then the first control loop of the control circuit 400 that comprises the first LDO control amplifier 120 and the PMOS LDO transistor 140 is operated (step 1250). When the value of the input voltage $V_{SWITCHER}$ is less than the value of the reference voltage $V_{REF}$ then the second control loop of the control circuit 400 that comprises the second LDO control amplifier 420 and the NMOS LDO transistor 410 is operated (step 1260).

Figure 13:
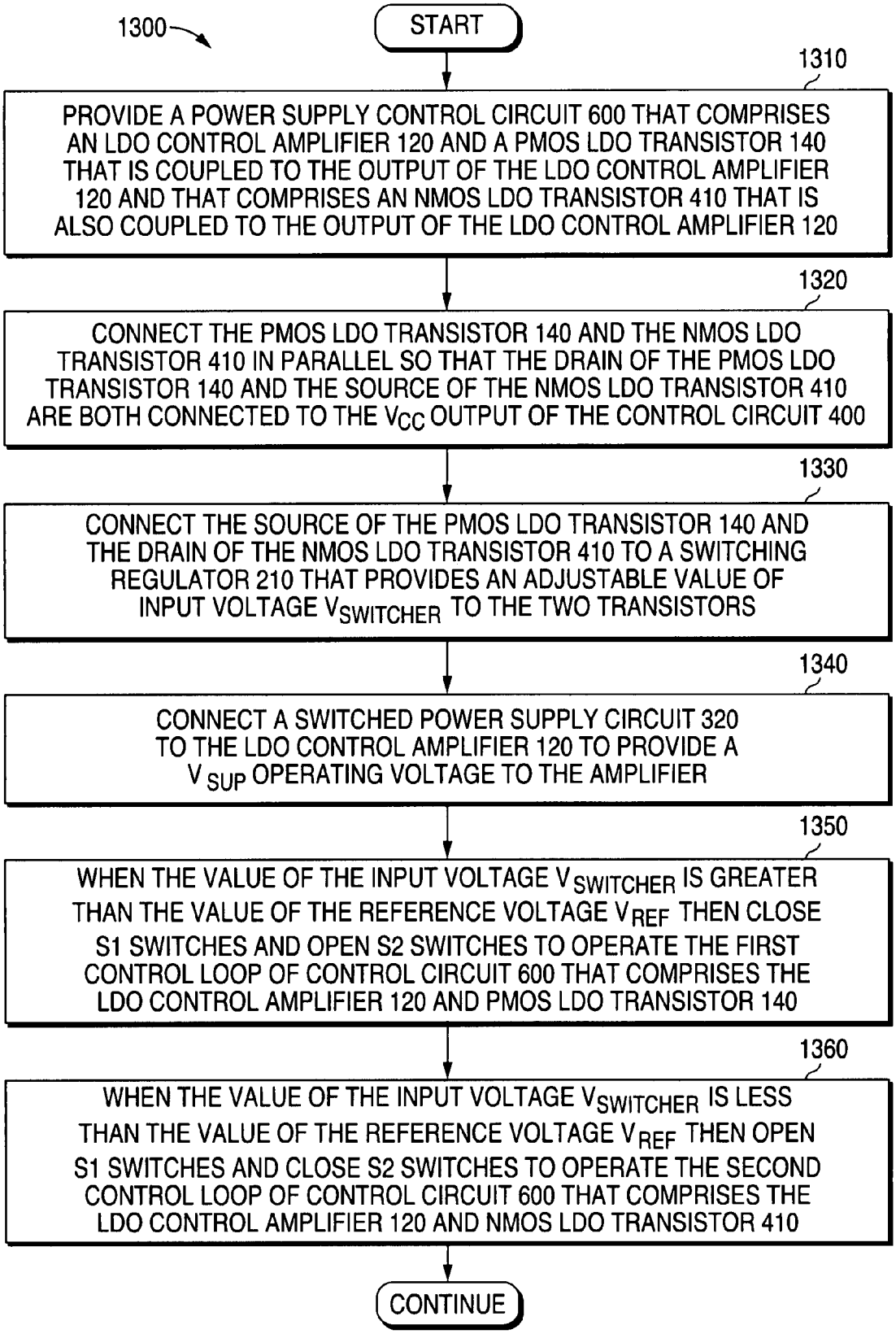
FIG. 13 illustrates a flow chart showing the steps of a third advantageous embodiment of the method of the present invention.

FIG. 13 illustrates a flow chart showing the steps 1300 of a third advantageous embodiment of the method of the present invention. In the first step of the method a power supply control circuit 600 is provided that comprises an LDO control amplifier 120 and a PMOS LDO transistor 140 that is coupled to the output of the LDO control amplifier 120, and an NMOS LDO transistor 410 that is also coupled to the output of the LDO control amplifier (step 1310). Then the PMOS LDO transistor 140 and the NMOS LDO transistor 410 are connected in parallel so that the drain of the LDO transistor 140 and the source of the LDO NMOS transistor 410 are both connected to the $V_{CC}$ output of the power supply control circuit 600 (step 1320).

Then the source of the PMOS LDO transistor 140 and the drain of the NMOS LDO transistor 410 are connected to a switching regulator 210 that provides an adjustable value of input voltage $V_{SWITCHER}$ to the two transistors (step 1330). Then a switched power supply circuit 320 is connected to the LDO control amplifier 120 to provide a $V_{SUP}$ operating voltage to the control amplifier (step 1340).

When the value of the input voltage $V_{SWITCHER}$ is greater than the value of the reference voltage $V_{REF}$ then the S1 switches are closed and the S2 switches are opened to operate the first control loop of the control circuit 600 that comprises the LDO control amplifier 120 and the PMOS LDO transistor 140 (step 1350). When the value of the input voltage $V_{SWITCHER}$ is less than the value of the reference voltage $V_{REF}$ then S1 switches are opened and the S2 switches are closed to operate the second control loop of the control circuit 600 that comprises the LDO control amplifier 120 and the NMOS LDO transistor 410 (step 1360).

Although the present invention has been described with an exemplary embodiment, various changes and modifications may be suggested to one skilled in the art. It is intended that the present invention encompass such changes and modifications as fall within the scope of the appended claims.

What is claimed is:

1. A power supply control circuit comprising:

a low drop out circuit that comprises an operational amplifier having an output coupled to a low drop out transistor;

a switcher circuit having an output coupled to the low drop out circuit, the switcher circuit configured to provide a first operating voltage to the low drop out transistor; and a switched power supply circuit having an output coupled to the operational amplifier, the switched power supply circuit configured to provide a second operating voltage to the operational amplifier with which the operational amplifier prevents the low drop out transistor from constantly being in an "on" condition or constantly being in an "off" condition.

2. The power supply control circuit as set forth in claim 1 wherein the second operating voltage is a greater one of: the first operating voltage and a voltage from a battery voltage source.

3. The power supply control circuit as set forth in claim 2 wherein the switched power supply circuit comprises:

a voltage comparator circuit having a first input that is configured to receive the first operating voltage and having a second input that is configured to receive the voltage from the battery voltage source.

4. The power supply control circuit as set forth in claim 3, wherein:

the voltage comparator circuit is configured to output a first signal when the voltage comparator circuit determines that the first operating voltage is greater than the voltage from the battery voltage source; and the voltage comparator circuit is configured to output a second signal when the voltage comparator circuit determines that the first operating voltage is less than the voltage from the battery voltage source.

5. The power supply control circuit as set forth in claim 4 wherein the switched power supply circuit further comprises:

circuitry that is configured to provide the first operating voltage to the operational amplifier when the voltage comparator circuit outputs the first signal; and circuitry that is configured to provide the voltage from the battery voltage source to the operational amplifier when the voltage comparator circuit outputs the second signal.

6. The power supply control circuit as set forth in claim 5 wherein the circuitry that is configured to provide the first operating voltage to the operational amplifier when the voltage comparator circuit outputs the first signal comprises:

a P-type metal oxide semiconductor (PMOS) transistor that is configured to operate as a first switch to connect the first operating voltage to the operational amplifier; and wherein the circuitry that is configured to provide the voltage from the battery voltage source to the operational amplifier when the voltage comparator circuit outputs the second signal comprises:

an N-type metal oxide semiconductor (NMOS) transistor that is configured to operate as a second switch to connect the voltage from the battery voltage source to the operational amplifier.

7. A power supply control circuit comprising:

a low drop out circuit that comprises a first low drop out transistor and a second low drop out transistor coupled in parallel;

a first operational amplifier having an output coupled to the first low drop out transistor and a second operational amplifier having an output coupled to the second low drop out transistor;

a switcher circuit having an output coupled to the low drop out circuit, the switcher circuit configured to provide a first operating voltage to the first low drop out transistor and to the second low drop out transistor; and a switched power supply circuit having a first output coupled to the first operational amplifier and having a second output coupled to the second operational amplifier, the switched power supply circuit configured to provide a second operating voltage to the first operational amplifier with which the first operational amplifier prevents the first low drop out transistor from being out of control, the switched power supply circuit also configured to provide the second operating voltage to the second operational amplifier with which the second operational amplifier prevents the second low drop out transistor from being out of control.

8. The power supply control circuit as set forth in claim 7 wherein the second operating voltage is a greater one of: the first operating voltage and a voltage from a battery voltage source.

9. The power supply control circuit as set forth in claim 8 further comprising a loop control switch circuit that is configured to alternately select an operation of (1) a first loop of the power supply control circuit that comprises the first operational amplifier and the first low drop out transistor and (2) a second loop of the power supply control circuit that comprises the second operational amplifier and the second low drop out transistor.

10. The power supply control circuit as set forth in claim 9 wherein the loop control switch circuit comprises:

a loop control voltage comparator having a first input that is configured to receive the first operating voltage and a second input that is configured to receive a reference voltage;

wherein the reference voltage is greater than a threshold voltage of the first low drop out transistor and greater than a threshold voltage of the second low drop out transistor.

11. The power supply control circuit as set forth in claim 10 wherein the loop control voltage comparator of the loop control switch circuit is configured to:

provide an output signal that operates the first loop and does not operate the second loop when the first operating voltage is greater than the reference voltage; and provide an output signal that operates the second loop and does not operate the first loop when the first operating voltage is less than the reference voltage.

12. The power supply control circuit as set forth in claim 7 wherein the first low drop out transistor comprises a P-type metal oxide semiconductor (PMOS) transistor and the second low drop out transistor comprises an N-type metal oxide semiconductor (NMOS) transistor.

13. The power supply control circuit as set forth in claim 10 wherein the switched power supply circuit is configured to provide the second operating voltage to the loop control voltage comparator.

14. A power supply control circuit comprising:

a low drop out circuit that comprises a first low drop out transistor and a second low drop out transistor coupled in parallel;

an operational amplifier having an output coupled to the first low drop out transistor and to the second low drop out transistor, the operational amplifier having a plurality of switched inputs;

a switcher circuit having an output coupled to the low drop out circuit, the switcher circuit configured to provide a first operating voltage to the first low drop out transistor and to the second low drop out transistor; and a switched power supply circuit having an output coupled to the operational amplifier, the switched power supply circuit configured to provide a second operating voltage to the operational amplifier with which the operational amplifier prevents the first low drop out transistor from being out of control and prevents the second low drop out transistor from being out of control.

15. The power supply control circuit as set forth in claim 14 wherein the second operating voltage is a greater one of: the first operating voltage and a voltage from a battery voltage source.

16. The power supply control circuit as set forth in claim 15 further comprising switching circuitry that is configured to alternately select an operation of (1) a first loop of the power supply control circuit that comprises the operational amplifier and the first low drop out transistor and (2) a second loop of the power supply control circuit that comprises the operational amplifier and the second low drop out transistor.

17. The power supply control circuit as set forth in claim 16 wherein the switching circuitry comprises:

a plurality of "switch one" switches; and a plurality of "switch two" switches;

wherein the first loop is configured to operate and the second loop is configured to not operate when the plurality of "switch one" switches are closed and the plurality of "switch two" switches are open; and wherein the second loop is configured to operate and the first loop is configured to not operate when the plurality of "switch two" switches are closed and the plurality of "switch one" switches are open.

18. The power supply control circuit as set forth in claim 17 wherein the switching circuitry further comprises:

a loop control voltage comparator that is configured to receive the first operating voltage on a first input and that is configured to receive a reference voltage on a second input, the loop control voltage comparator also configured to provide a signal that closes the plurality of "switch one" circuits when the first operating voltage is greater than the reference voltage and to provide a signal that opens the plurality of "switch one" circuits when the first operating voltage is less than the reference voltage.

19. A power supply control circuit comprising:

a low drop out circuit that comprises a first low drop out transistor and a second low drop out transistor coupled in parallel;

an operational amplifier having a first output coupled to the first low drop out transistor and having a second output coupled to the second low drop out transistor;

a switcher circuit having an output coupled to the low drop out circuit, the switcher circuit configured to provide a first operating voltage to the first low drop out transistor and to the second low drop out transistor; and a switched power supply circuit having an output coupled to the operational amplifier, the switched power supply circuit configured to provide a second operating voltage to the operational amplifier with which the operational amplifier prevents the first low drop out transistor from being out of control and prevents the second low drop out transistor from being out of control;

wherein the second operating voltage is a greater one of: the first operating voltage and a voltage from a battery voltage source.

20. The power supply control circuit as set forth in claim 19 further comprising switching circuitry that is configured to alternately select an operation of (1) a first loop of the power supply control circuit that comprises the operational amplifier and the first low drop out transistor and (2) a second loop of the power supply control circuit that comprises the operational amplifier and the second low drop out transistor.

21. The power supply control circuit as set forth in claim 20 further comprising:

a P-type metal oxide semiconductor (PMOS) compensation circuit coupled to the first loop of the power supply control circuit; and an N-type metal oxide semiconductor (PMOS) compensation circuit coupled to the second loop of the power supply control circuit.

* * * * *